United States Patent [19]

Uemura et al.

[11] Patent Number: 4,620,919

[45] Date of Patent: Nov. 4, 1986

[54] PITCH FOR THE PRODUCTION OF CARBON FIBERS

[75] Inventors: Seiichi Uemura, Tokyo; Hiroaki Takashima, Kawasaki; Osamu Kato, Yokohama; Hazime Nakazima, Hiratsuka, all of Japan

[73] Assignee: Nippon Oil Company, Japan

[21] Appl. No.: 812,792

[22] Filed: Dec. 23, 1985

[30] Foreign Application Priority Data

Dec. 28, 1984 [JP] Japan ..... 59-274280

[51] Int. Cl.[4] ..... C10C 1/18; C10C 3/02; C10C 1/00

[52] U.S. Cl. ..... 208/45; 208/22; 208/39; 423/447.6; 423/447.4

[58] Field of Search ..... 208/45, 22, 39; 423/447.4, 447.6

[56] References Cited

U.S. PATENT DOCUMENTS

| | | | |
|---|---|---|---|
| 4,184,942 | 1/1980 | Angier et al. | 208/45 |
| 4,277,325 | 7/1981 | Greenwood | 208/22 |
| 4,402,928 | 9/1983 | Lewis et al. | 208/45 |
| 4,443,324 | 4/1984 | Diefendorf et al. | 208/22 |
| 4,465,586 | 8/1984 | Diefendorf et al. | 208/45 |
| 4,502,943 | 3/1985 | Dickakian | 208/22 |
| 4,503,026 | 3/1985 | Dickakian | 208/45 |
| 4,534,850 | 8/1985 | Izumi et al. | 208/45 |

FOREIGN PATENT DOCUMENTS

| | | | |
|---|---|---|---|
| 1120697 | 10/1984 | European Pat. Off. | 208/39 |
| 2829288 | 1/1979 | Fed. Rep. of Germany | 208/45 |
| 1116792 | 9/1980 | Japan | 208/45 |

*Primary Examiner*—Andrew H. Metz
*Assistant Examiner*—Helane Myers
*Attorney, Agent, or Firm*—Scully, Scott, Murphy & Presser

[57] ABSTRACT

Pitch for the production of carbon fibers which contains from 5 to 40% of the optically anisotropic region which is insoluble in organic solvents having a solubility parameter from 7.4 to 9.0 but is soluble in organic solvents having a solubility parameter from 9.2 to 11.0.

4 Claims, 3 Drawing Figures

PITCH FOR THE PRODUCTION OF CARBON FIBERS

BACKGROUND OF THE INVENTION

The present invention relates to pitch having excellent properties for the production of carbon fibers.

There is known a method of producing carbon fibers of high strength and high modulus of elasticity in which pitch is subjected to heat treatment to obtain meso-phase pitch containing from 40 to 100% of optically anisotropic liquid crystals and the meso-phase pitch is then subjected to melt spinning, infusiblization and carbonization (for example, see Japanese Patent Laid Open No. 19127/1971).

It is also known that if pitch with a meso-phase content of 40% or lower heretofore known is employed, there will takes place separation of the optically anisotropic and isotropic regions, and the melt spinning would result in frequent end breakages and, in extreme cases, production of fibers in which undissolved particles are connected. Treatment of such fibers by a conventional method is known not to produce carbon fibers having high strength and high modulus of elasticity.

Therefore, most of the prior-art processes are directed to a method of producing carbon fibers having high strength and high modulus of elasticity by the use of pitch containing from 40 to 100%, particularly from 70 to 100% of meso-phase pitch. Almost no attempts have been made to produce carbon fibers having high strength and high modulus of elasticity by using pitch of a meso-phase content of 40% or lower.

Pitch having a higher meso-phase content, however, is very high in softening point as well as in viscosity and usually requires melt spinning carried out at a temperature as high as 350° C. or higher. Consequently, pyrolysis and heat polymerization of the pitch are apt to occur in the course of melt spinning with such problems as evolution of light gases and formation of infusible components associated so that homogeneous spinning is difficult to accomplish.

Moreover, carbon fibers obtained from pitch of a high meso-phase content have a tendency to form so-called radial structure which is composed of crystals radiately arranged on the cross ection. Such structure causes a problem of longitudinally generating cracks to reduce the strength.

SUMMARY OF THE INVENTION

It is an object of this invention to solve the above-mentioned problems of the prior arts.

Another object of the invention is to provide a method which enables more homogeneous spinning and production of carbon fibers of high strength and high modulus of elasticity by improving solubility characteristics of pitch having a low meso-phase content associated with a low softening point and a low viscosity.

The present invention resides in pitch for the production of carbon fibers containing an optically anisotropic region from 5 to 40% which is insoluble in organic solvents having a solubility parameter from 7.4 to 9.0 but is soluble in organic solvents having a solubility parameter from 9.2 to 11.0.

DESCRIPTION OF THE PREFERRED EMBODIMENTS

Figure 1:
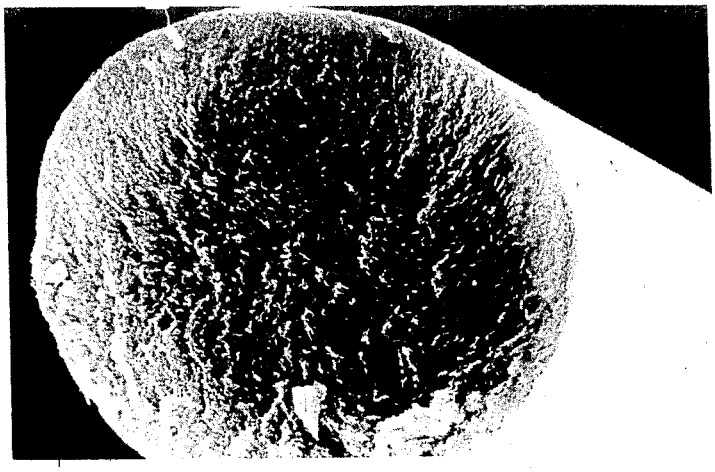

According to the present invention, pitch for the production of carbon fibers is produced by the method described below.

First, carbonaceous pitch is heat-treated usually at a temperature from 340° to 500° C. for a period from 1 minute to 30 hours to prepare pitch containing an optically anisotropic region from 5 to 100%, preferably from 5 to 60% and more preferably from 5 to 40%. The heat treatment is preferably carried out in an atmosphere of an inert gas such as nitrogen passed through. It is preferred to pass the inert gas at a rate from 0.7 to 5.0 scfh/lb. pitch.

Next, the optically anisotropic pitch containing an optically anisotropic region from 5 to 100% thus obtained is subjected to an extraction treatment with an organic solvent having a solubility parameter from 7.4 to 9.0 at 25° C., preferably from 7.6 to 8.4 to collect insolubles. The insolubles are then subjected to an extraction treatment with an organic solvent having a solubility parameter from 9.2 to 11.0 at 25° C., preferably from 10.0 to 10.8 to collect solubles. There is thus obtained pitch of the invention for the production of carbon fibers containing an optically anisotropic region from 5 to 40%.

The organic solvent extraction is carried out usually at atmospheric pressure or under pressure at ordinary temperature or an elevated temperature, for example, at a temperature from 15° to 230° C. Although the mixing ratio of the organic solvent to the pitch may be varied depending upon such conditions as pressure and temperature, a ratio of 10–150 parts of the organic solvent per part of the pitch is usually employed. The treatment is carried out for a period of time sufficient to extract a portion, preferably 50% or more and more preferably substantially all of the solubles.

The organic solvent having a solubility parameter from 7.4 to 9.0 as used herein includes not only organic solvents having a solubility parameter in said range when used alone but also mixtures of two or more solvents adjusted to a solubility parameter in the range from 7.4 to 9.0. In the latter case, the mixture may be employed by adjusting the solubility parameter to a value in the range from 7.4 to 9.0 even if any of the two or more organic solvents, taken alone, has a solubility parameter beyond the range from 7.4 to 9.0. The organic solvents having a solubility parameter from 9.2 to 11.0 may be mixtures prepared in the same way as described above.

As particular examples of the organic solvent having a solubility parameter from 7.4 to 9.0, when taken alone, are mentioned (solubility parameter indicated in the parenthesis), carbon tetrachloride (8.6), 1,1-dichloroethane (8.9), 1,2-dichloropropane (9.0), propyl chloride (8.4), methylethylether (7.6), furan (8.4), 1-chlorobutane (8.4), t-butyl chloride (7.5), diethylether (7.4), isobutylamine (8.5), cyclohexane (8.2), xylene (8.8), octane (7.6) and cumene (8.8).

As particular examples of the organic solvent having a solubility factor from 9.2 to 11.0, when taken alone, are mentioned carbon disulfide (10.0), chloroform (9.3), dichloromethane (9.7), 1,1,2-trichloroethane (9.6), acetone (10.0), methylethylketone (9.3), pyridine (10.6), dichlorobenzene (10.0), chlorobenzene (9.5), benzene (9.2), naphthalene (10.6) and nitrobenzene (10.2).

Any combination is possible when two or more organic solvents are combined to give a mixture having a predetermined solubility parameter.

The pitch for the production of carbon fibers according to the invention is subjected to melt spinning by a known method such as extrusion spinning, centrifugal spinning or spray spinning.

The pitch fibers obtained by the melt spinning is then subjected to infusiblization treatment in an atmosphere of oxidative gas. As the oxidative gas is employed one or more of oxidative gases such as oxygen, ozone, air, nitrogen oxides, halogens and sulfur dioxide. The infusiblization treatment is carried out under such temperature condition that will not soften and deform the material to be treated, namely, the melt-spun pitch fibers. For example, a temperature from 20° to 360° C., preferably from 20° to 300° C. is employed. The treatment is effected usually for a period from 5 minutes to 10 hours.

The infusiblized carbon fibers are then subjected to carbonization or graphitization in an atmosphere of inert gas to produce carbon fibers. The carbonization is carried out usually at a temperature from 800° to 2000° C. The period of time generally required for the carbonization is from 0.5 minutes to 10 hours. When graphitization is further performed, it is done at a temperature from 2000° to 3000° C. for a period from 1 second to 1 hour.

Melt spinning of the pitch for the production of carbon fibers according to the present invention enables not only to run homogeneous spinning but also to spin at a high rate of 1000 m/min or more. The spinning can be carried even at a rate of 1500 m/min or more without difficulty.

Moreover, the carbon fibers obtained from the pitch of the invention have so-called random structure in which crystals are arranged in mozaic on the cross section. Under appropriate conditions, so-called onion structure in which crystals are arranged in the direction of circumference is produced with a result that carbon fibers of high strength are produced due to generation of no cracks in the fibers.

The invention will be described in more details below with reference to examples and comparative examples. It is to be understood that the invention is not limited thereto.

EXAMPLE 1

Light oil obtained from Arabian crude oil was catalytically cracked to produce heavy oil properties of which were shown in Table 1. The heavy oil was heat-treated under a pressure of 15 $Kg/cm^2 \cdot G$ and at a temperature of 430° C. for 3 hours and then distilled at 250° C./1 mmHg to give starting pitch softening at 85° C. and containing 25% of benzene insolubles.

Heat treatment of 30 g of the starting pitch at 400° C. for 1 hour while passing nitrogen at a rate of 600 ml/min with stirring afforded the optically anisotropic pitch (1) softening at 215° C. and containing 35% of the meso phase.

The optically anisotropic pitch (1) was finely pulverized and subjected to an extraction treatment with hexane at 25° C. in a proportion of 100 ml of cyclohexane (solubility parameter: 8.2) per 5 g of the pitch (1) to collect cyclohexane insolubles.

The cyclohexane insolubles were then subjected to an extraction treatment with nitrobenzene at 80° C. in a proportion of 100 ml of nitrobenzene (solubility parameter: 10.2) per 5 g of the cyclohexane insolubles to collect nitrobenzene solubles.

Removal of nitrobenzene from the nitrobenzene solubles yielded the pitch (2) for the production of carbon fibers which softened at 203° C. and contained 25% of the meso-phase.

The pitch (3) thus obtained was subjected to a melt spinning at 248° C. by means of a spinning machine with nozzles 0.3 mm$\phi$ in diameter and L/D=2 to produce 11–13$\mu$ pitch fibers. The pitch fibers were further subjected to infusiblization, carbonization and graphitization treatments under conditions shown below:

Infusiblization—Heated under oxygen containing 2% by volume of $NO_2$ to 300° C. at a rate of 5° C./min and maintained at that temperature for 5 minutes.

Carbonization—Heated under nitrogen to 1000° C. at a rate of 10° C./min and maintained at that temperature for 30 minutes.

Graphitization—Heated under nitrogen to 2500° C. at a rate of 25° C./min.

The carbon fibers thus obtained had a tensile strength of 285 $Kg/mm^2$ and a Young's modulus of 32 $tons/mm^2$.

Cross section of the carbon fiber showed fine random structure (see FIG. 1 which is a photograph of the cross ection structure).

EXAMPLE 2

Thirty grams of the starting pitch (2) of Example 1 was heat-treated at a temperature of 400° C. for a period of 6 hours while passing nitrogen at a rate of 600 ml/min with stirring. There was obtained the optically anisotropic pitch (3) softening at 277° C. and containing 95% of the meso phase.

The optically anisotropic pitch (3) was finely pulverized and then subjected to an extraction treatment with hexane-benzene 1:1 mixed solvent (solubility parameter: 8.2) at 60° C. in a proportion of 100 ml of the solvent per 5 g of the pitch (3) to collect hexane-benzene mixed solvent insolubles.

The hexane-benzene mixed solvent insolubles were subjected to an extraction treatment with benzene-equinoline 1:1 mixed solvent (solubility parameter: 10.5) at 80° C. in a proportion of 100 ml of the solvent per 3 g of the insolubles to collect benzene-quinoline mixed solvent solubles.

Removal of the solvent from the benzene-quinoline mixed solvent solubles yielded the pitch (4) for the production of carbon fibers which softened at 220° C. and contained 35% of the meso phase.

The pitch (4) thus prepared was subjected to a melt spinning at 268° C. using the same spinning machine as used in Example 1, followed by infusiblization, carbonization and graphitization to give carbon fibers.

The carbon fibers thus obtained had a tensile strength of 370 $Kg/mm^2$ and a Young's modulus of 48 $tons/mm^2$.

Cross section of the carbon fiber showd fine random structure similar to that in FIG. 1.

COMPARATIVE EXAMPLE 1

The optically anisotropic pitch (1) used in Example 1 which contained 35% of the meso phase was subjected to a melt spinning carried out in the same way as in Example 1.

End breakages frequently occurred and continuous spinning was infeasible.

EXAMPLE 3

The starting pitch of Example 1 was treated at 400° C. under hydrogen at a pressure of 200 Kg/cm$^2$·G for 9 hours in the presence of a cobalt-molybdenum carrier catalyst in a proportion of 3 g of the catalyst per 100 g of the starting pitch. Then, the catalyst was separated to give hydrogenated pitch softening at 45° C. and containing 1.0% of benzene insolubles.

To 30 g of the hydrogenated pitch was applied a heat treatment at 400° C. for 4 hours while passing nitrogen at a rate of 600 ml/min with stirring to produce the optically anisotropic pitch (5) softening at 188° C. and containing 30% of the meso-phase.

The optically anisotropic pitch (5) was finely pulverized and then subjected to an extraction treatment with a mixed solvent of 60% by weight of hexane and 40% by weight of benzene (solubility parameter: 8.0) at 60° C. in a proportion of 100 ml of the solvent per 3 g of the pitch (5) to collect hexane-benzene mixed solvent insolubles.

The benzene-hexane mixed solvent insolubles were then subjected to an extraction treatment with a mixed solvent of 90% by weight of benzene and 10% by weight of quinoline (solubility parameter: 9.4) at 80° C. in a proportion of 100 ml of the solvent per 3 g of the insolubles to collect benzene-quinoline mixed solvent solubles.

Removal of the solvent from the benzene-quinoline mixed solvent solubles gave the pitch (6) for the production of carbon fibers which softened at 208° C. and contained 33% of the meso-phase.

The pitch (6) for the production of carbon fibers thus prepared was subjected to a melt spinning at 253° C. using the same spinning machine as used in Example 1, followed by infusiblization, carbonization and graphitization carried out in the same way as in Example 1 to produce carbon fibers.

The carbon fibers thus obtained had a tensile strength of 390 Kg/mm$^2$ and a Young's modulus of 54 tons/mm$^2$.

Cross section of the carbon fiber had fine onion structure. Photograph of the sectional structure is shown in FIG. 1.

COMPARATIVE EXAMPLE 2

The optically anisotropic pitch (5) used in Example 3 which contained 30% of the meso-phase was subjected to a melt spinning at 230° C. using the same spinning machine.

Figure 3:
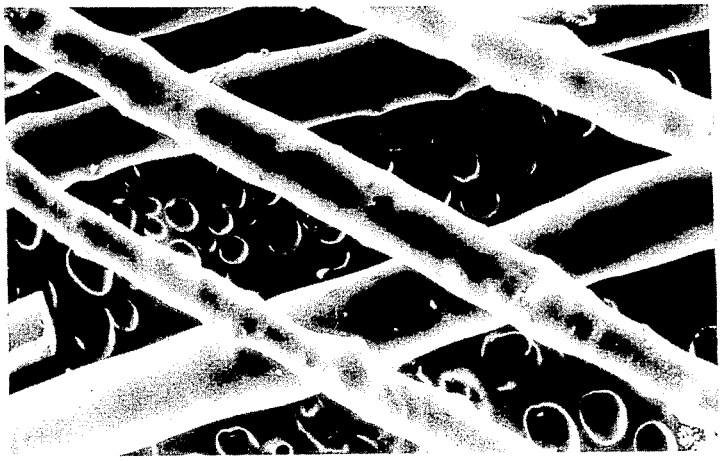

End breakages frequently occurred and continuous spinning was infeasible. Photograph of the pitch fibers is shown in FIG. 3. As seen from FIG. 3, the pitch fibers are similar to insoluble particles bonded in a line.

EXAMPLE 4

Heavy oil formed as a by-product in a steam cracking of naphtha carried out at 830° C. the properties of which were shown in Table 2 was treated at a temperature of 400° C. under a pressure of 15 Kg/cm$^2$·G for 3 hours followed by distillation at 250° C./1 mmHg to give starting pitch softening at 82° C. and containing 29% of benzene insolubles.

Heat treatment of 30 g of the starting pitch at a temperature of 400° C. for 10 hours while passing nitrogen at a rate of 600 ml/min with stirring yielded the optically anisotropic pitch (7) which softened at 321° C. and contained 98% of the meta phase.

The optically anisotropic pitch (7) was subjected to solvent extraction treatments in the same way as in Example 1 to give the pitch (8) for the production of carbon fibers which softened at 245° C. and contained 18% of the meso-phase.

The pitch (8) for the production of carbon fibers thus prepared was subjected to a melt spinning at 295° C. using the same spinning machine as used in Example 1, followed by infusiblization, carbonization and graphitization carried out in the same way as in Example 1 to produce carbon fibers.

The carbon fibers thus obtained had a tensile strength of 255 Kg/mm$^2$ and a Young's modulus of 27 tons/mm$^2$.

TABLE 1

| | |
|---|---|
| Specific gravity (15° C./4° C.) | 0.965 |
| Distillation range | |
| First boiling point | 320° C. |
| 5% | 340° C. |
| 10% | 353° C. |
| 30% | 385° C. |
| 50% | 415° C. |
| 70% | 445° C. |
| 90% | 512° C. |

TABLE 2

| | |
|---|---|
| Specific gravity (15° C./4° C.) | 1.02 |
| Refractive index | 1.5867 |
| Distillation range | |
| First boiling point | 163° C. |
| 10% | 208° C. |
| 30% | 226° C. |
| 50% | 239° C. |
| 70% | 262° C. |
| 90% | 317° C. |

Figure 2:
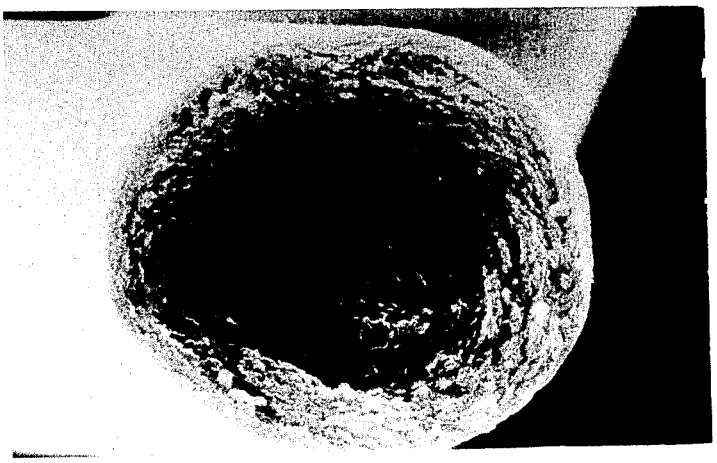

In the accompanying drawings, FIGS. 1–3 are microscopic pictures of the carbon fibers produced in the examples.

What is claimed is:

1. Pitch for the production of carbon fibers which contains from 5 to 40% of the optically anisotropic region which is insoluble in organic solvents having a solubility parameter from 7.4 to 9.0 but is soluble in organic solvents having a solubility parameter from 9.2 to 11.0.

2. Process for producing pitch for the production of carbon fibers which comprises subjecting optically anisotropic pitch to extraction treatment with an organic solvent having a solubility parameter from 7.4 to 9.0 to collect insolubles and subjected said insolubles to extraction treatment with an organic solvent having a solubility parameter from 9.2 to 11.0 to collect solubles thereby preparing pitch containing from 5 to 40% of the optically anisotropic region.

3. Process according to claim 2 wherein the organic solvent having a solubility parameter from 7.4 to 9.0 is carbon tetrachloride, 1,1-dichloroethane, 1,2-dichloropropane, propyl chloride, methylethylether, furan, 1-chlorobutane, t-butyl chloride, diethylether, isobutylamine, cyclohexane, xylene, octane or cumene.

4. Process according to claim 2 wherein the organic solvent having a solubility parameter from 9.2 to 11.0 is carbon disulfide, chloroform, dichloromethane, 1,1,2-trichloroethane, acetone, methylethylketone, pyridine, dichlorobenzene, chlorobenzene, benzene, naphthalene or nitrobenzene.

* * * * *